United States Patent [19]

Gilliland

[11] 4,124,917

[45] Nov. 14, 1978

[54] LUBRICATABLE FLOOR GLIDE FOR HEAVY APPLIANCES

[76] Inventor: William O. Gilliland, 10128 Denison Ave., Cupertino, Calif. 95014

[21] Appl. No.: 820,871

[22] Filed: Aug. 1, 1977

[51] Int. Cl.[2] ..... A47B 91/06

[52] U.S. Cl. ..... 16/42 R

[58] Field of Search ..... 16/42 R, 42 T; 248/346.1; 104/134, 279

[56] References Cited

U.S. PATENT DOCUMENTS

| | | | |
|---|---|---|---|
| 1,212,220 | 1/1917 | Hight | 16/42 R |
| 1,356,794 | 10/1920 | Smith | 16/42 R X |
| 1,506,043 | 8/1924 | Bishop | 16/42 R X |
| 1,864,933 | 6/1932 | Pynynski | 16/42 R X |

*Primary Examiner*—Dorsey Newton

*Attorney, Agent, or Firm*—Flehr, Hohbach, Test, Albritton & Herbert

[57] ABSTRACT

A glide shoe of molded plastic to be employed with major appliances is constructed to be able to provide a liquid bearing of a lubricating liquid beneath the shoe to minimize the danger of damage to irregular floor surfaces, such as sculptured vinyl material as the appliance slides across the floor covering. A method of sliding a major appliance across the uneven surface of a sculptured floor covering while being supported on a liquid bearing of lubricating fluid is characterized by the step of applying a lubricating liquid beneath each shoe to form a liquid bearing therebeneath, in which the lubricating liquid includes liquid detergent.

5 Claims, 5 Drawing Figures

LUBRICATABLE FLOOR GLIDE FOR HEAVY APPLIANCES

BACKGROUND OF THE INVENTION

This invention pertains to a glide shoe or coaster of a type for receiving the supporting feed of a major appliance or of other heavy equipment and to the method of moving heavy equipment supported in such glide shoes across an uneven support surface covering. More particularly this invention pertains to a method and means for providing a lubricated liquid bearing beneath the bottom surface of a glide shoe and the uneven supporting surface of a floor covering or the like to ease the effort in maneuvering appliances thereon while minimizing the danger of the edges of the feet from doing damage to the floor covering.

At present many major appliances are supported by small feet carried on adjustable legs so as to be able to level the appliance once it is positioned. The small feet have a relatively low profile and if the appliance is moved by sliding it across the surface of modern cushioned vinyl material or the like there exists a real danger of gouging or cutting the floor covering by engagement of the edge of the feet of the appliance with a raised portion of the floor covering. The foregoing problem makes the handling of major appliances rather difficult, especially for a person acting alone.

SUMMARY OF THE INVENTION AND OBJECTS

In general, a glide shoe for receiving one of the feet or ends of the legs of an appliance or other heavy equipment comprises a base portion of molded plastic material having a floor engaging bottom surface formed therebeneath. An upwardly extending edge portion, integral with the base portion, forms a cavity for receiving one of the feet of the appliance as well as a small body of liquid disposed therein. Several flow passages extend between the cavity and the bottom surface of the base member. At least some of the flow passage ends within the cavity are disposed free and clear of the foot in the cavity to remain open even when a foot is disposed therein so as to permit a lubricating liquid disposed in the cavity to flow to the interface defined between the bottom surface of the glide shoe and the floor covering. In this way a lubricated liquid bearing is provided at the interface.

In general, the invention includes the method of safely sliding heavy equipment across an irregular floor covering, such as sliding a major appliance supported on small feet which have a relatively thin side edge profile. The method includes the steps of disposing each of the feet of the appliance in the upwardly open caivty of an associated glide shoe. The next step is to apply lubricating liquid beneath each shoe to form a liquid bearing therebeneath followed by urging the equipment in the direction of the desired movement. Preferably the lubricating liquid includes liquid detergent.

In general it is an object of the present invention to provide an improved glide shoe article and method.

Another object of the present invention is to provide a glide shoe and method particularly useful for manipulating large major appliances across a sculptured or other irregular floor covering surface without doing damage to the floor covering.

It is a further object of the present invention to provide means for moving a major appliance across the irregular surface of a sculptured floor covering while supporting the appliance on a liquid bearing of lubricating material.

The foregoing and other objects of the invention will become more readily evident when considered in conjunction with the drawings.

DETAILED DESCRIPTION OF PREFERRED EMBODIMENTS

Figure 1:
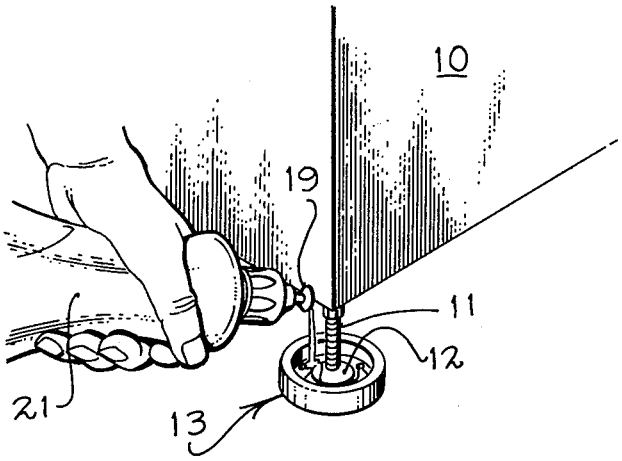
FIG. 1 shows a diagramatic perspective view of a glide shoe disposed in operative position beneath a major appliance with lubricating liquid being deposited into same for carrying out the method according to the invention.
Figure 2:
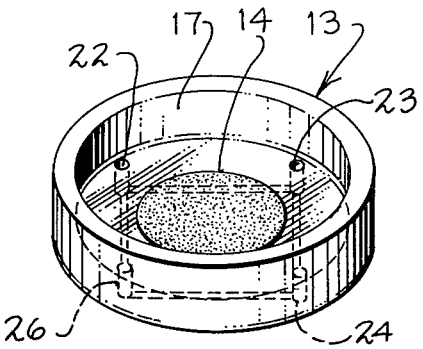
FIG. 2 shows a perspective view of a glide shoe contruction according to the invention.

As shown in FIG. 1 a piece of heavy equipment such as a major appliance 10, such as a refrigerator, washing machines, freezer, or the like is shown with one of its several adjustable legs 11 extending downwardly therefrom. At the bottom of leg 11 a relatively low profile foot element 12 of conventional construction is carried.

A glide shoe 13 of molded plastic material is held to the bottom of foot element 12 by means of a double sided adhesive stamp 14 for convenience.

Glide shoe 13 includes a base portion 16 and a relatively easily accessible cavity 17 thereabove for receiving a foot element 12. Cavity 17 is defined by an upwardly extending peripheral edge portion 18 integral with base portion 16.

Accordingly, cavity 17 is adapted to receive a deposit of a lubricating liquid, such as liquid detergent, as can be readily supplied from the spout 19 of a conventional container 21 thereof.

A plurality of flow passages 22, 23, 24, 26 extend between cavity 17 and the bottom surface 27 of base portion 16 so as to deliver liquid detergent from cavity 17 to the interface 28 defined between the floor covering surface 29 and bottom surface 27. In this way a liquid bearing is formed between the support surface 29 and bottom surface 27 to support glide shoes 13 thereon.

A pattern of grooves 31–34 formed in the bottom surface of base portion 16 serves to interconnect the ends of flow passages 22–24, 26 for channeling the liquid detergent generally under bottom surface 27. In this way the liquid detergent is spread generally around beneath the bottom surface 27 rather than limited to a single region thereof.

The upper ends of one or more of flow passages 22–24, 26 are disposed and arranged whereby one or more of the flow passages will remain unobstructed even with a foot element 12 disposed within cavity 17.

Figure 5:
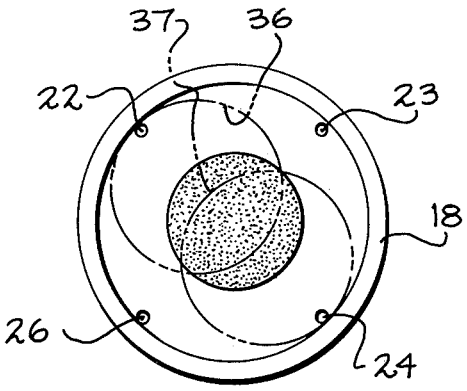
FIG. 5 shows a top plan view with phantom positions of an appliance foot disposed therein.
Figure 3:
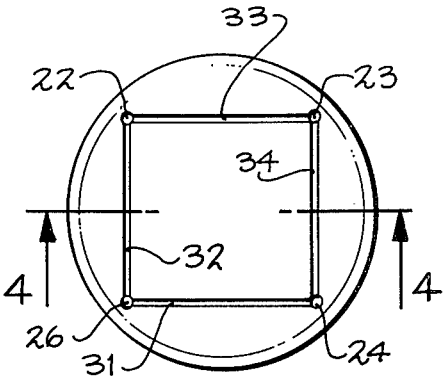
FIG. 3 shows a bottom plan view of the glide shoe shown in FIG. 2 according to the invention.
Figure 4:
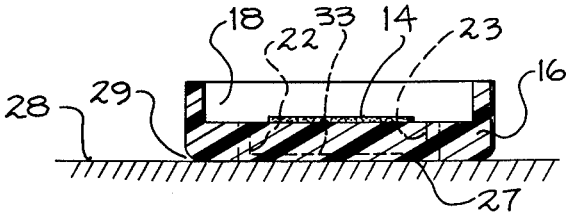
FIG. 4 shows a side elevation section view taken along the line 4—4 of FIG. 3.

For example, as shown in FIG. 5, positions of foot element 12 are represented by each of the two phantom circles 36, 37. It is to be noted that the position 36 of element 12 covers only one of the four flow passages, namely flow passage 22. Position 37 of foot element 12 covers one flow passage, 24. However, the grooves 31–34 formed on bottom surface 27 of base portion 16 form interconnecting channels for distributing the flow of the liquid detergent throughout the bottom surface region beneath glide shoe 13. Should the feet 12 be large enough to close off all flow passages it is evident that the cavity 17 would no longer readily receive the foot element 12.

By locating flow passages 22–24, 26 closely adjacent the upwardly extending inner wall surface of edge portion 18, normally only one flow passage can be closed by a foot element 12 dimensioned to be readily received in cavity 17.

In operation and use a method of sliding heavy equipment such as major appliances of a type supported on small feet across an irregular floor covering surface includes the steps of disposing each of the feet of the equipment in the upwardly open cavity of an associted glide shoe. The next step is to form a lubricated liquid bearing between the underside of the shoes and the support surface therebeneath by feeding a lubricating liquid through the glide shoe to the underlying support surface while the feet of the equipment remain disposed within the cavities of the glide shoes. Preferably in the method described above the lubricating liquid which is disposed in the cavity of the glide shoe comprises liquid detergent.

From the foregoing it will be readily evident that the method of disposing each of the feet of the heavy equipment in the upwardly open cavities of glide shoes followed by applying a lubricating liquid beneath each shoe serves to form a liquid bearing bet ween the shoes and the support surface. Ultimately the equipment is urged in the direction of desired movement and this requires a minimum of effort since the equipment is now supported on a lubricating liquid bearing.

I claim:

1. A glide shoe for readily receiving one of a plurality of supporting foot elements of a heavy appliance for sliding same across a floor surface while supported on a fluid bearing, said shoe comprising means for supporting thereon one of the foot elements and having a floor engaging bearing surface, means carried by the first named means and forming a cavity disposed above the first named means, the last named means including a sufficiently large and unobstructed access opening for passing a foot element of an appliance into said cavity to be supported upon the bottom of said cavity, said cavity being adapted to receive a deposit of fluid lubricant therein, a plurality of flow passages extending between said cavity and said bearing surface for delivering fluid lubricant from said cavity to the interface defined between the floor surface and said bearing surface to form a fluid bearing therebetween supporting said glide shoe thereon, and grooves formed in said bearing surface interconnecting said flow passages for channeling the liquid therebetween to provide a general distribution of said liquid beneath said bearing surface.

2. A glide shoe for readily receiving one of a plurality of supporting foot elements of a heavy appliance for sliding same across a floor surface while supported on a fluid bearing, said shoe comprising means for supporting thereon one of the foot elements and having a floor engaging bearing surface, means carried by the first named means and forming a cavity disposed above the first named means, the last named means including a sufficiently large and unobstructed access opening for passing a foot element of an appliance into said cavity to be supported upon the bottom of said cavity, said cavity being adapted to receive a deposit of fluid lubricant therein, a plurality of flow passages extending between said cavity and said bearing surface for delivering fluid lubricant from said cavity to the interface defined between the floor surface and said bearing surface to form a fluid bearing therebetween supporting said glide shoe thereon, and means for retaining said shoe to the foot element.

3. The method of sliding heavy equipment of a type supported on small feet across a supporting surface comprising the steps of disposing each of the feet of said equipment in an upwardly open cavity of an associated one of a plurality of glide shoes so as to rest upon the bottom of each said cavity, feeding a lubricating liquid from the cavity of each of the glide shoes to the underlying support surface while the feet of the equipment remain disposed within the cavities of the shoes to form a lubricated liquid bearing between the undersides of the shoes and the support surface therebeneath.

4. The method according to claim 3 in which the lubricating liquid includes liquid detergent.

5. A glide shoe for receiving the supporting feet or ends of the legs of an appliance comprising a base portion of molded plastic material having a floor engaging bottom surface, an upwardly extending wall portion integral with said base portion forming a cavity for readily receiving one of the feet of an appliance and a body of liquid, a plurality of flow passages extending between said cavity and said bottom surface, at least one of the flow passages in said cavity being disposed to remain open when a foot is disposed therein to permit a lubricating liquid disposed in the cavity to flow to the interface defined between said bottom surface and the floor to provide a liquid bearing at said interface, means in said cavity for adhering said shoe to a foot readily received in said cavity.

* * * * *